US007147031B2

(12) United States Patent
Grassi et al.

(10) Patent No.: US 7,147,031 B2
(45) Date of Patent: Dec. 12, 2006

(54) LOST PATTERN MOLD REMOVAL CASTING METHOD AND APPARATUS

(75) Inventors: John R. Grassi, Kennesaw, GA (US); John Campbell, West Malvern (GB); George W. Kuhlman, Coral Springs, FL (US)

(73) Assignee: Alotech Ltd. LLC, Kennesaw, GA (US)

( * ) Notice: Subject to any disclaimer, the term of this patent is extended or adjusted under 35 U.S.C. 154(b) by 103 days.

(21) Appl. No.: 10/665,783

(22) Filed: Sep. 19, 2003

(65) Prior Publication Data

US 2004/0108088 A1 Jun. 10, 2004

Related U.S. Application Data

(60) Provisional application No. 60/412,176, filed on Sep. 20, 2002.

(51) Int. Cl.
*B22C 9/04* (2006.01)

(52) U.S. Cl. ..... 164/34; 164/131; 164/529; 164/522; 164/35

(58) Field of Classification Search ..... 164/34, 164/131, 529, 369, 522, 345, 35
See application file for complete search history.

(56) References Cited

U.S. PATENT DOCUMENTS

| | | | | |
|---|---|---|---|---|
| 22,865 | A | 2/1859 | Gardiner | |
| 185,376 | A | 12/1876 | Whitehouse | |
| 381,655 | A | 4/1888 | Stover | |
| 927,495 | A | 7/1909 | Custer | |
| 1,241,867 | A | 10/1917 | McMillen | |
| 2,968,848 | A * | 1/1961 | Carter | 164/128 |
| 3,124,452 | A | 3/1964 | Kraft | |
| 3,540,519 | A | 11/1970 | Yates | |
| 3,620,291 | A | 11/1971 | Delachapelle | |
| 3,863,702 | A | 2/1975 | Hallerberg et al. | |
| 3,958,619 | A | 5/1976 | Petersen et al. | |
| 4,222,429 | A | 9/1980 | Kemp | |
| 4,347,890 | A | 9/1982 | Ailin-Pyzik et al. | |
| 4,399,858 | A | 8/1983 | Kurabe et al. | |
| 4,548,256 | A | 10/1985 | Glinn et al. | |
| 4,580,616 | A * | 4/1986 | Watts | 164/457 |
| 4,582,118 | A | 4/1986 | Jacoby et al. | |
| 4,607,091 | A | 8/1986 | Schreiber | |
| 4,610,295 | A | 9/1986 | Jacoby et al. | |

(Continued)

FOREIGN PATENT DOCUMENTS

| | | |
|---|---|---|
| CH | 622 726 | 4/1981 |

(Continued)

OTHER PUBLICATIONS

Patent Abstracts of Japan; Publication No. 61007058; Publication Date Jan. 13, 1986.

(Continued)

*Primary Examiner*—Kevin Kerns
*Assistant Examiner*—I.-H. Lin
(74) *Attorney, Agent, or Firm*—Fay, Sharpe, Fagan, Minnich & McKee, LLP

(57) ABSTRACT

A method and apparatus for the lost pattern casting of metals employs an erodable mold including a particulate material and a binder. An erodable backing or coating may be used to support the erodable mold. After a molten metal casting is poured in the mold, the erodable backing and the mold are contacted with a solvent. This cools the molten metal so that it at least partially solidifies to form a casting. At least a part of the mold is removed. Also, the coating or backing may be removed.

47 Claims, 5 Drawing Sheets

U.S. PATENT DOCUMENTS

| | | | | | |
|---|---|---|---|---|---|
| 4,629,708 | A | | 12/1986 | Alexander et al. | |
| 4,709,740 | A | | 12/1987 | Jacoby et al. | |
| 4,724,887 | A | | 2/1988 | Jacoby et al. | |
| 4,802,525 | A | | 2/1989 | Heine et al. | |
| 4,854,368 | A | | 8/1989 | Vezirian | |
| 4,971,134 | A | * | 11/1990 | Kawaguchi et al. | 164/122 |
| 4,987,950 | A | | 1/1991 | Yu | |
| 5,143,665 | A | | 9/1992 | Clubbs et al. | |
| 5,148,853 | A | | 9/1992 | Yu et al. | |
| 5,158,130 | A | * | 10/1992 | Sahari | 164/528 |
| 5,294,648 | A | | 3/1994 | Smith et al. | |
| 5,327,955 | A | * | 7/1994 | Easwaran | 164/516 |
| 5,333,673 | A | | 8/1994 | Hughes | |
| 5,439,045 | A | | 8/1995 | Crafton | |
| 5,573,055 | A | | 11/1996 | Melling et al. | |
| 5,641,015 | A | * | 6/1997 | Challand | 164/528 |
| 5,681,407 | A | | 10/1997 | Yu et al. | |
| 5,725,044 | A | | 3/1998 | Hirokawa | |
| 5,738,162 | A | | 4/1998 | Crafton | |
| 5,810,918 | A | | 9/1998 | Landis | |
| 5,820,705 | A | | 10/1998 | Yu et al. | |
| 5,913,354 | A | | 6/1999 | Conroy et al. | |
| 5,915,452 | A | * | 6/1999 | Conroy et al. | 164/345 |
| 5,957,188 | A | | 9/1999 | Crafton | |
| 6,139,619 | A | | 10/2000 | Zaretskiy et al. | |
| 6,336,809 | B1 | | 1/2002 | Crafton et al. | |
| 6,390,178 | B1 | | 5/2002 | Makino | |
| 6,447,593 | B1 | | 9/2002 | Sargent et al. | |
| 6,469,299 | B1 | | 10/2002 | Chutjian et al. | |
| 6,547,556 | B1 | | 4/2003 | Crafton et al. | |
| 6,551,396 | B1 | * | 4/2003 | Pineda et al. | 106/38.9 |
| 2002/0020511 | A1 | | 2/2002 | Crafton et al. | |
| 2002/0104596 | A1 | | 8/2002 | Crafton et al. | |
| 2004/0055728 | A1 | | 3/2004 | Lewis, Jr. et al. | |
| 2005/0022957 | A1 | | 2/2005 | Crafton et al. | |
| 2005/0072549 | A1 | | 4/2005 | Crafton et al. | |
| 2005/0145362 | A1 | | 7/2005 | Crafton et al. | |

FOREIGN PATENT DOCUMENTS

| | | | | | |
|---|---|---|---|---|---|
| DE | 32 15 809 | | 11/1983 | | |
| DE | 36 16 168 | | 11/1987 | | |
| EP | 0 141 666 | | 5/1985 | | |
| EP | 0 119 365 | | 9/1987 | | |
| EP | 0 744 233 | | 11/1996 | | |
| EP | 0 899 038 | | 3/1999 | | |
| FR | 2 614 814 | | 11/1988 | | |
| GB | 1 549 220 | | 7/1979 | | |
| GB | 2 248 569 | A | 4/1992 | | |
| JP | 59156566 | * | 9/1984 | | 165/35 |
| JP | 5-169185 | | 7/1993 | | |

OTHER PUBLICATIONS

Niedling, Jake J. et al., "Evaluating RSI Sows For Safe Charging Into Molten Metal", Light Metals 2003, TMS (The Minerals, Metals & Materials Society), 2003, pp. 695-700.

Ekenes, J. Martin et al., "Cause and Prevention of Explosions Involving Hot-Top Casting of Aluminum Extrusion Ingot", Light Metals 2003, TMS (The Minerals, Metals & Materials Society), 2003, pp. 687-693.

* cited by examiner

LOST PATTERN MOLD REMOVAL CASTING METHOD AND APPARATUS

The present application claims priority from U.S. provisional patent application No. 60/412,176, filed Sep. 20, 2002.

FIELD OF THE INVENTION

The present invention relates to the casting of metals. More particularly, the present invention relates to the lost pattern process for the casting of metals. Still more particularly, the present invention relates to a method and an apparatus for the lost pattern mold removal casting of metals.

BACKGROUND OF THE INVENTION

One of the processes that is used for the casting of metals is investment casting, commonly known in the art as the lost pattern process. The lost pattern process is often used to create castings of complex shapes, increased dimensional accuracy (such as control of wall thickness), and/or smooth surface characteristics.

In the lost pattern process, a pattern is made and sacrificed when the molten metal is poured. A variety of pattern materials may be used, such as foam, wax, frozen mercury, or frozen water. The material to be used for the pattern depends upon the metal that is to be cast and the specific design considerations for the cast part. The lost pattern process using a foam pattern, i.e., the lost foam process, will be described herein, although it is to be understood that the invention may be used on any known lost pattern process.

The lost foam process involves the injection of foam beads, typically of polystyrene, into a cavity in an aluminum die, where the beads are expanded by steam to fill the cavity. The expanded beads form a pattern that conforms to the shape of the die cavity. Turning to FIG. 1, the pattern 10 is removed from the die cavity and glued to a runner 12 that allows the molten metal to reach the pattern 10 upon pouring. To form a more complex pattern, several individually formed patterns may be glued together.

With reference to FIG. 2, the pattern 10 and runner 12 are dipped into a slurry of ceramic material to form a coating 14 on the pattern 10. The coating 14 is dried and the pattern 10 with the runner 12 and coating 14 is lowered into a flask 16, as shown in FIG. 3. The flask 16 is filled with a backing material such as unbonded sand 18 that is packed around the pattern 10, often by vibration. The vibration allows the sand 18 to penetrate and support the entire pattern 10 and runner 12. A portion of the runner 12 extends to the top 20 of the flask 16 to facilitate the pouring of molten metal.

Turning to FIG. 4, a crucible 22, or similar vessel, contains molten metal (not shown) that is poured through the runner 12 and into the pattern 10. As the molten metal contacts the foam of the runner 12 and the pattern 10, the foam rapidly decomposes and is vaporized. The molten metal thus replaces the foam and the ceramic coating 14 maintains the desired shape and surface characteristics for the casting. The unbonded sand 18 supports the coating 14 to control the dimensional stability of the ceramic coating 14, and thus of the cast part.

The flask 16 is set aside to allow the cast part to cool and solidify, also known as freezing. Once cooling is complete, as FIG. 5 illustrates, the cast part 24, including a gate 26 to be trimmed, is removed from the sand 18 either by extracting the part 24 from the sand 18 or dumping the sand 18 out of the flask 16. The sand 18 is typically reclaimed and re-used. The ceramic coating 14 (referring back to FIG. 4) is removed from the cast part 24 by tumbling or another operation known to those skilled in the art.

However, the lost foam process has some well-known disadvantages. For one, the tooling is highly complex and therefore expensive. Complex parts, such as cylinder heads and blocks, can only be made by specialist tool makers. For these reasons, the process is generally limited to those parts requiring long production runs.

Also, the contact of molten metal with the foam of the pattern causes the evolution of undesirable fumes, creates contamination of the backing aggregate as the styrene decomposes and prematurely cools the molten metal. In addition, as the styrene foam decomposes, it may release hydrogen, which is captured by the molten metal and thus creates significant defects. A lack of uniformity of the density distribution in the foam may also prevent a smooth or predictable filling of the mold, allowing the molten metal to advance more rapidly in some sections of the mold and then fold back as other sections fill, thereby enfolding defects.

These disadvantages have been reduced by a number of alternative techniques in the lost foam casting process. For example, once the pattern is in the flask and supported by the backing material, the foam may be removed before the molten metal is poured. This elimination of the foam before pouring the molten metal may be performed according to the Replicast Process, as known in the art. In this manner, the disadvantages associated with the molten metal contacting the foam may be reduced or eliminated.

Other processes, such as counter-gravity filling (disclosed in U.S. Pat. No. 6,103,182) and the application of pressure after pouring the molten metal, have also reduced some of the disadvantages of the lost foam process.

Still, the foam patterns are relatively weak and must withstand handling and being dipped in the ceramic slurry. This causes designs of patterns to focus on strength rather than better filling, thereby sacrificing optimum casting process characteristics. The weakness of foam patterns also often leads to distortion of the patterns when the backing material is poured around the pattern in the flask. Such weakness of the patterns leads to a need for a coating that may lend more structural support to the patterns.

Other disadvantages of the lost foam casting process are associated with the slow cooling of the cast metal. As mentioned above, after the molten metal is poured into the mold, the mold is typically set aside until enough heat has been lost from the metal so that it has solidified, whereupon the casting is removed from the mold.

The sand that serves as the backing material in lost foam casting is most commonly silica. However, silica experiences an undesirable transition from alpha quartz to beta quartz at about 570 degrees Celsius (° C.), or 1,058 degrees Fahrenheit (° F.). In addition, a silica backing aggregate typically does not allow rapid cooling of the molten metal due to its relatively low thermal conductivity.

Rapid cooling of the molten metal is often desirable, as it is known in the art that with such cooling the mechanical properties of the casting are improved. Moreover, rapid cooling allows the retention of more of the alloying elements in solution, thereby introducing the possibility of eliminating subsequent solution treatment, which saves time and expense. The elimination of solution treatment prevents the quench that typically follows, removing the problems of distortion and residual stress in the casting that are caused by the quench.

As a result, it is desirable to develop a lost foam casting process and related apparatus that provide the advantages of increased structural support of the pattern and more rapid solidification of the cast metal.

BRIEF SUMMARY OF THE INVENTION

In an exemplary embodiment of the present invention, a process for the lost pattern mold removal casting of metals is provided. The process includes the steps of forming a pattern from a material, forming an erodable aggregate coating around at least a portion of the pattern to form a mold, the coating including a particulate or granular material and a binder, removing the pattern from the mold, delivering molten metal into the mold, contacting a solvent with the mold, cooling the molten metal such that it at least partially solidifies to form a casting, and removing at least a part of the mold.

In another exemplary embodiment of the present invention, an assembly for the lost pattern mold removal casting of metals is provided. The assembly includes a mold, at least a portion of which includes an erodable aggregate.

In yet another exemplary embodiment of the present invention, an apparatus is provided for the lost pattern casting of metals whereby a lost pattern mold is at least partially eroded and the casting is cooled and solidified by contact with a solvent. The apparatus includes, an erodable lost pattern mold, an erodable backing at least partially surrounding and supporting the mold, and a nozzle for delivering a solvent to contact at least a part of the mold and the backing.

In still another embodiment of the invention, a process for the lost pattern casting of metals is provided. The process includes the steps of forming a pattern from a material, forming a ceramic coating around at least a portion of the pattern to form a mold, forming an erodable backing around at least a portion of the mold, removing the pattern from the mold, delivering molten metal into the mold, contacting a solvent with the erodable backing to erode at least a part of the backing, cooling the molten metal such that it at least partially solidifies to form a casting, and removing the ceramic coating.

BRIEF DESCRIPTION OF THE DRAWINGS

The invention may take physical form in certain parts and arrangement of parts or certain process steps, preferred embodiments of which will be described in detail in this specification and illustrated in the accompanying drawings, which form a part hereof and wherein.

DETAILED DESCRIPTION OF THE INVENTION

Figure 6:
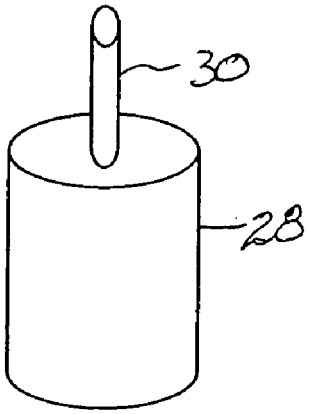
FIG. 6 is a schematic perspective view of a pattern.

Referring now to the drawings, wherein the showings are for purposes of illustrating the preferred embodiments of the invention and not for the purposes of limiting the same, FIG. 6 illustrates a foam pattern 28 with a gate 30 attached to it.

Figure 7:
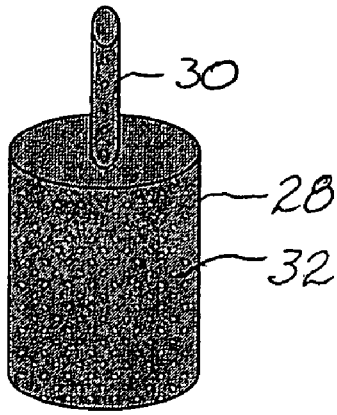
FIG. 7 is a schematic perspective view of the pattern of FIG. 6 with a coating in accordance with one embodiment of the present invention.

Turning to FIG. 7, the pattern 28 and gate 30 may be dipped into a slurry of an erodable or removable coating 32. The erodable coating 32 may be an aggregate composed of a particulate material and a binder. The particulate material may be a material having a minimal thermal capacity and/or minimal thermal conductivity (i.e. a minimal heat diffusivity) to reduce the heat that is extracted from the cast molten metal. By reducing the heat that is extracted, the molten metal does not solidify prematurely and thus flows smoothly into all portions of the pattern 28, including thin areas. The particulate material may also have a low coefficient of thermal expansion and no phase change, allowing use of the coating 32 to high temperatures while retaining high dimensional accuracy.

In a preferred embodiment, the aggregate of the erodable coating 32 may be composed of approximately spherical particles, which impart a good surface finish to the casting. Of course, the particulate material may be of any other defined shape as well, such as pentagonal, hexagonal, etc., as well as irregularly shaped. The size of the particles should be fine enough to allow the creation of a good surface finish on the casting, but the size may be increased if the coating 32 is to be permeable to vent gases.

An exemplary material to be used for the particulate material of the erodable coating 32 is cenospheres, a constituent of fly ash. Cenospheres are inert, naturally occurring hollow microspheres comprised largely of silica and alumina. Although their physical and chemical makeup may vary, a typical cenosphere may contain, e.g., about 55–75 weight percent (wt. %) amorphous silica, 10–25 wt. % alumina, 1–10 wt. % sodium oxide, 1–10 wt. % potassium oxide, 0.1–5 wt. % calcium oxide and 0.1–5 wt. % iron oxide. The exact composition of the cenospheres is not critical. Cenospheres are light in weight with a specific gravity ranging from about 0.70 to about 2.35, depending on the grade. They have low thermal capacity and thus extract little heat from molten metal, allowing increased flow of molten metal in the mold.

Other exemplary materials that may be used for the particulate material include, but are not limited to, crushed pumice particles (an amorphous foamed mineral); silica sand; ceramic, glass or refractory micro-bubbles; and mixtures of the above. Other types of volcanic glass such as perlite may also be used. Generally, any type of granular material having a quantity of trapped air between and/or within the packed particles and having a low heat capacity and thermal conductivity may be used.

The aggregate of the erodable coating 32 is bonded with a binder that is soluble. The binder may be an inorganic material that will pick up little or no hydrogen, preventing detrimental exposure of the molten metal to hydrogen. As a result, the binder may contain no water or hydrocarbons. Such a lack of water or hydrocarbons also allows the erodable coating 32 to be dried at high temperatures or heated up to the casting temperature of the metal, well above the boiling point of water. The binder may also have low gas evolution when the molten metal is cast, reducing the need for a coating 32 that is permeable. The avoidance of a permeable coating 32 allows the use of more finely sized particles for the aggregate, which is advantageous, as described above.

An exemplary binder possessing the described characteristics is based on phosphate glass, a binder that is known in the art. Phosphate glass is an amorphous, water-soluble material that includes phosphoric oxide, $P_2O_5$, as the principal constituent with other compounds such as alumina and magnesia or sodium oxide and calcium oxide. Other exemplary binders include inorganic silicates, such as sodium silicate, borates, phosphates, sulfates, such as magnesium sulfate, and mixtures thereof. Further exemplary binders include systems wherein an organic binder, such as urethane, is added to a known inorganic binder and the organic binder is in the range of from about 1 weight percent (wt. %) to about 51 wt. % of the binder system.

The proportion of the mixture of the binder and the particulate material in the erodable coating 32 is determined by the viscosity needed to effectively coat the pattern 28 and gate 30. For example, the proportion should yield a workable slurry that allows the coating 32 to coat all exterior surfaces of the pattern 28, while remaining thick enough to support the pattern 28 and provide an effective containment of the molten metal. It is to be noted that other additives that are known in the art may be included in the erodable coating 32 to aid in wetting and the reduction of foaming.

Figure 8:
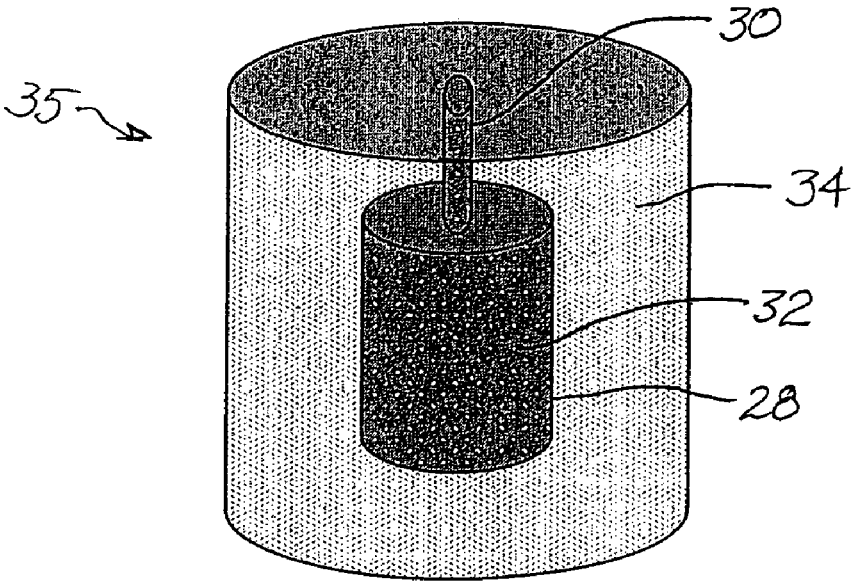
FIG. 8 is a schematic perspective view of the pattern and coating of FIG. 7 with backing material in accordance with another embodiment of the present invention.

With reference to FIG. 8, once the erodable coating 32 has dried, the pattern 28 and gate 30 are placed in an erodable backing 34. The erodable backing 34 is composed of a particulate material and a binder. The particulate material may be the same as that described above for the erodable coating 32, with the optional addition of another exemplary material that may be used, a known non-silica synthetic particulate material. Although contemplated by the invention, primarily silica sand based aggregates are not preferred because the alpha/beta quartz transition causes many different defects. For example, the sudden expansion around hot-spots causes buckling of the coating 32 and sometimes, if occurring over a larger volume, leads to major distortions of the casting. In addition to which, the use of fine silica particles in the coating 32 is often avoided because of health and safety considerations.

The binder of the erodable backing 34 can be the same as that described above for the erodable coating 32. A primary difference between the composition of the erodable coating 32 and the erodable backing 34 is the amount of binder. For the erodable backing 34, a very low percentage of binder may be used compared to the erodable coating 32, due essentially to the function of the erodable backing 34 as a support medium, rather than a coating medium. The amount of binder in the erodable backing 34 may be fifty percent (50%) or less than that used in a mold for conventional (i.e., not lost pattern process) casting.

Other differences between the composition of the erodable coating 32 and the erodable backing 34 can include additives for specific processing considerations, or specific particulate material and binder material choices. For example, the erodable coating 32 may include cenospheres as the aggregate and a binder based on phosphate glass, while the erodable backing 34 may include a particulate material of silica (or other) sand and a binder of an inorganic silicate.

An advantage to the use of the binder in the erodable backing 34 is the creation of a free-standing mold 35, thereby eliminating the need for a flask 16 (referring back to FIG. 3). The benefits of this advantage will be examined in detail below.

Figure 9:
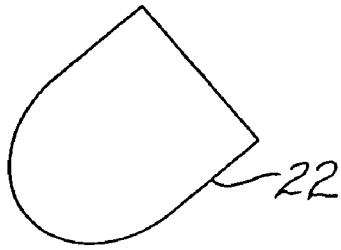
FIG. 9 is a schematic perspective view of the pattern and backing material of FIG. 8 with a crucible and solvent delivery system.
Figure 9:
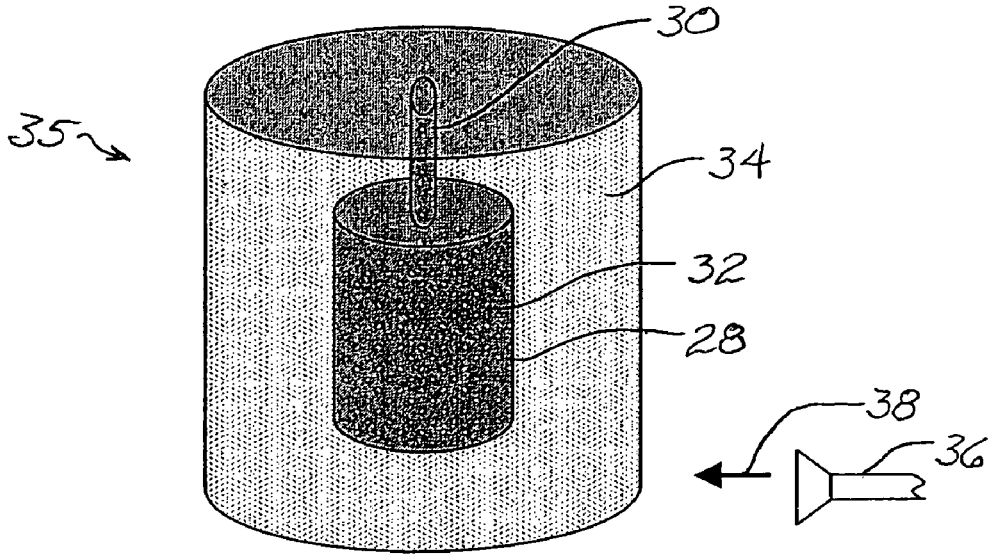

Turning to FIG. 9, once the erodable backing 34 is in place, molten metal is poured into the gate 30 via the crucible 22 or another source for molten metal, as known in the art. While the system illustrated is that of gravity pouring, counter-gravity casting using conventional low pressure, or a pump, such as the one disclosed in U.S. Pat. No. 6,103,182 may also be utilized, enhancing the quality of the casting. To encourage the filling of narrow sections, the mold 35 may be heated to increase the flow of the molten metal. The process may be performed with or without removing the foam prior to pouring the molten metal. Moreover, related processes may be involved, such as the Replicast Process, whereby the foam may be eliminated prior to the pouring of the molten metal, leading to improved qualities in the casting.

After the metal is poured, the erodable backing 34 and the erodable coating 32 are progressively subjected to the action of a solvent. As mentioned, the binder of the erodable backing 34 and the erodable coating 32 is soluble. Thus, the solvent dissolves the binder and thereby causes the backing 34 and the coating 32 to decompose.

An exemplary solvent is water. Water is environmentally acceptable and has high heat capacity and latent heat of evaporation, allowing it to absorb a significant amount of heat before evaporating. It can thus provide an optimum cooling effect to enable rapid solidification of the cast metal. The water can be at ambient temperature or can be heated. In some instances, it may be possible to use steam in place of water.

Other solvents may include liquids or gases that decompose the binder and cool the cast metal. For example, known quenching agents may be used with appropriately soluble binders. Moreover, a grit may be entrained in the cooling fluid (liquid or gas) and used to decompose the erodable backing 34 and the erodable coating 32 by abrasion, at the same time as the backing 34 and/or the coating 32 are being washed away by the fluid.

An exemplary manner of delivery of the solvent is by a spray nozzle 36 that directs a jet of solvent 38, such as water, at the erodable backing 34. The jet 38 may be delivered in any suitable configuration from a narrow stream to a wide fan and may be a steady stream or a pulsating stream, as dictated by the particular application.

The delivery of solvent, i.e., the spray, may begin at the base of the mold 35. The mold 35 can be lowered to allow the nozzle 36 to deliver the solvent in a progressive manner to intact portions of the erodable backing 34 so that the backing 34 decomposes. Once the backing 34 is decomposed in a particular area, the solvent continues to be delivered to the coating 32 to cause the coating 32 to decompose as well. In the alternative, the mold 35 may remain stationary and the nozzle 36 may be caused to move in order to progressively deliver a solvent jet 38 to decompose the erodable backing 34 and the coating 32. In order to allow the entire circumference of the backing 34 and the coating 32 to be contacted by the jet 38 for rapid decomposition, they may be rotated or the spray nozzle 36 may be moved about them. Also, several spaced jets can be used, if desired, as described below. An exemplary method and apparatus for the removal of the mold is described in copending U.S. patent application Ser. No. 10/614,601 filed on Jul. 7, 2003 and entitled "Mold Removal Casting Method and Apparatus", the disclosure of which is incorporated herein by reference in its entirety.

The rate and pressure of delivery of the jet 38 are of a setting that is high enough to decompose the erodable backing 34 and the erodable coating 32, yet low enough to allow the solvent to percolate through the backing 34 and the coating 32 so that percolated solvent arrives at the cast metal ahead of the full force of the jet 38. For example, high volume, low pressure delivery in a range of about 0.5 to 50 liters per second, Lps (10 to 100 gallons per minute, gpm) at a pressure ranging from 0.03 to 70 bar (0.5 to about 1,000 pounds per square inch, psi) may be advantageous. In this manner, the percolated solvent causes the formation of a relatively solid skin on the cast metal before the metal is contacted by the force of the jet 38, thereby preventing distortion of the metal or explosion from excessive direct contact of the solvent with the molten metal.

An additional consideration is the increased binder composition of the erodable coating 32 compared to the erodable backing 34. The increased binder composition amount requires more solvent to decompose the erodable coating 32 than the erodable backing 34, thereby slowing the approach of the solvent to the cast metal and reducing the undesirable effects of sudden, forceful contact of the solvent 38 with the cast metal. This action of the coating 32 to provide a temporary protection of the casting from the force of the water is one of the major advantages of the coating 32. It effectively enhances the robustness of the erosion/solidification process. Ultimately, however, the process can be made to work without the coating 32, as is evident of course from the existence of direct chill casting of aluminum alloy billets by the continuous casting process. In this analogous process, the careful progression of the action of cooling water jets on the unprotected casting surface as the casting passes through the jets is known in the art.

To enhance percolation of the solvent 38 through the erodable backing 34 and/or the erodable coating 32, a surfactant, as known in the art, may be added to the binder formulation. In addition, at least some of the heat that is absorbed from the molten metal by the coating 32 and the backing 34 may increase the temperature of the solvent as the solvent percolates through, thereby increasing the energy of the solvent and causing it to erode the backing 34 and the coating 32 more rapidly.

Another consideration for the rate and pressure of the delivery of the jet 38 is the contact of the solvent with the cast metal once the erodable backing 34 and the coating 32 have decomposed. The rate and pressure of the jet 38 must be low enough to prevent damage to the casting, but must be high enough to overcome the formation of a vapor blanket. A vapor blanket is formed by the evaporation of the solvent that has percolated through the erodable backing 34 and the coating 32 to contact the metal in forming the skin on the casting. The vapor blanket reduces the transfer of heat away from the cast metal and is detrimental to the rapid cooling that is necessary to obtain the desirable properties and effects that are described above. Thus, it is advantageous to adjust the jet 38 to overcome the vapor blanket.

Control of the jet 38 may be exercised in at least two ways. The rate and pressure of delivery may be set to achieve all of the above parameters, or two separate settings may be used. If two separate settings are used, one setting may be established for decomposition of the erodable backing 34 and at least a portion of the erodable coating 32, while a separate, reduced setting may be timed to replace the decomposition setting when the jet 38 is about to contact the cast metal. Of course, the manner in which the jet 38 is delivered, i.e., narrow stream, wide fan, steady flow, intermittent pulse, etc., will likely affect the rate and pressure settings of the jet 38 accordingly.

The solidification of the casting beginning at its base and progressing to its top allows the most recently poured metal (i.e., in the gate) to remain in a molten state for the maximum length of the time so that it may continue to feed the casting. By feeding the casting for a longer period of time, voids created by shrinkage of the metal upon cooling are minimized. Solidification from the base of the casting to the top also allows length or longitudinal changes to take place before solidification is complete, thereby eliminating any significant buildups of internal stress that often occur in quenching.

It is important to note that a single nozzle 36 is not limited to a base-to-top direction of spray as described above. Depending on the application, it may be desirable to spray the jet 38 from the top of the mold 35 to the bottom, from a midpoint to one end, or in some similar pattern. Some geometries of casting may benefit from the cooling being arranged horizontally, from one or more sides or ends of a casting to another, or simultaneously to meet at a central feeder, etc.

The application of solvent is not limited to a single direction or nozzle. For example, two or more nozzles may be present, eroding the backing 34 and the coating 32 from multiple directions. Each nozzle can spray a respective jet at the backing 34 and/or coating 32, decomposing them more rapidly and uniformly. Any number of nozzles may be present, as a great number of nozzles may be advantageous for large or complex castings, or a few nozzles may provide optimum coverage for other castings. As described above, the mold 35 may be rotated and moved vertically to allow complete distribution of the jets, or the nozzles may be moved while the mold assembly remains stationary.

In addition, when multiple nozzles are used, it may be advantageous to time the function of the nozzles to complement one another. For example, the bottom nozzle may be engaged, thereby spraying a jet at the bottom of the mold 35. The bottom nozzle may be turned off and side nozzles may be engaged to spray other jets at the mold 35, and so on. Such coordinated timing of multiple nozzles may optimize the decomposition of the mold 35 and/or the direction of cooling of the cast metal to provide the desired characteristics of the casting.

Moreover, when multiple nozzles are used, combinations of solvents and/or temperatures may be employed. For example, some nozzles could deliver jets of one solvent, while other nozzles deliver jets of a different solvent. Some nozzles could also deliver solvent at a first temperature, while other nozzles deliver the solvent at a different temperature.

Other solvent delivery systems are possible. One could, for example, direct the solvent to the erodable backing 34 and/or coating 32 via an impeller, over a waterfall, or other means. In addition, steam may be delivered under pressure toward the erodable backing 34 and the coating 32. Furthermore, it is conceivable that a binder and solvent combination could be developed of such effectiveness that the erodable backing 34 with the cast metal and the coating 32 could be eroded without rapid movement of the solvent, such as by dipping or immersing them into a bath of the solvent. In such a system, the water or other solvent (whether flowing or stagnant) would progressively dissolve the soluble binder, slowly disintegrating the erodable backing and/or coating. Thus, while one means of applying the solvent is via a nozzle, other means and combinations of means are also conceivable. The same considerations that are described above apply to these alternative delivery techniques, as the conditions of the delivery system must be adjusted according to the desired rate and manner of erosion.

As the backing 34 and the coating 32 decompose when sprayed with the solvent, at least some of the constituents may be reclaimed. The particulate material, and in some cases the binder, can be gathered for drying and re-use. Moreover, the solvent can be collected, filtered and recirculated for further use. In some systems, it may also be possible to reclaim the binder as well through a reclamation system as known in the art.

As mentioned above, the use of the binder in the erodable backing 34 allows the mold 35 to be free-standing and thus eliminates the need for a flask 16 (referring back to FIG. 3). The operation and materials associated with construction of the flask 16 are thereby eliminated, saving time and expense. In addition, the elimination of the flask 16 allows erosion to take place without restrictions, such as limited areas and angles of application of the solvent, which would be imposed with a flask 16.

In the case of the absence of a coating 32, the aggregate and binder mixture are compacted around the pattern to make a mold 35 of sufficient density in the traditional manner.

In the case of the use of a coating 32 on the pattern 28, the use of the binder in the backing material 34 also leads to a mold 35 that needs no active compaction and may therefore be more loosely compacted. This in turn reduces the curing time of the mold 35 and reduces the re-condensation of moisture in parts of the mold 35 that have already cured, leading to greater mold strength. Thus, the mold 35 has greater strength than would be expected, given the limited amount of binder used. The looser compaction may also create greater permeability of the mold 35, reducing problems of gas entrapment in casting.

Figure 10:
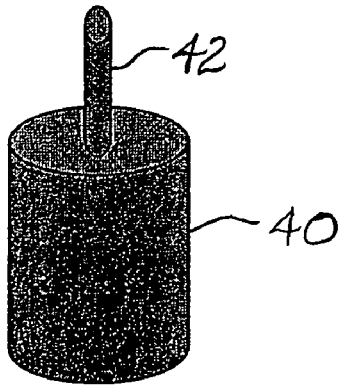
FIG. 10 is a schematic perspective view of a casting formed in accordance with an embodiment of the present invention.

Thus, the cast metal is exposed to the solvent as the erodable backing 34 and the erodable coating 32 decompose, causing the cast metal to cool rapidly and solidify. With reference to FIG. 10, a casting 40 with a gate 42 is ready for handling once the erodable backing 34 and the erodable coating 32 (referring back to FIG. 9) have been completely decomposed. This rapid cooling process results in a casting 40 with advantageous mechanical properties. Moreover, the delivery of a solvent in a manner such as spraying may have a strong zonal cooling effect on the cast metal, encouraging the whole casting to solidify progressively, thereby facilitating feeding and securing the soundness of the casting.

The gate 42 is normally trimmed from the casting 40, a step traditionally performed as a separate operation in the prior art. With the present invention, at least one jet of solvent may be designed to deliver solvent at a rate, volume and area sufficient to cut the gate 42 off, thereby eliminating an additional process step of the prior art.

As mentioned above, the elimination of the foam prior to casting may be a valuable step to improve the quality of the cast products. The foam may be eliminated by very hot gas, such as heated air, or the mold 35 may be placed in a heated furnace enclosure. Fume extraction during this step should also take place. Also as mentioned above, such heating of the mold 35, even if it is only over its internal surface, will greatly increase the potential for the filling of narrow sections of extensive area, which may constitute a major advantage of the process.

In accordance with the present invention, a substantially cooled casting that has been separated from the mold 35 is achieved rapidly. The mold 35 is allowed to only define the shape of the cast product and not to extract heat from the casting. The extraction of heat is carried out by the controlled process of freezing the casting with a solvent in a directional manner to promote the maximum properties and stress relief of the casting. By carrying out the heat extraction in a separate step, the filling of the mold 35, whether by gravity pouring, tilt pouring, or by counter gravity filling, encourages flow of the molten metal while minimizing premature solidification, allowing castings of complex geometry or thin sections to be achieved.

Figure 1:
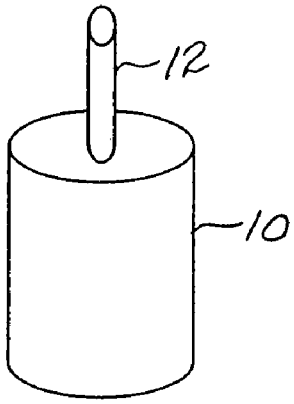
FIG. 1 PRIOR ART
FIG. 1 is a schematic perspective view of a pattern of the prior art.
Figure 2:
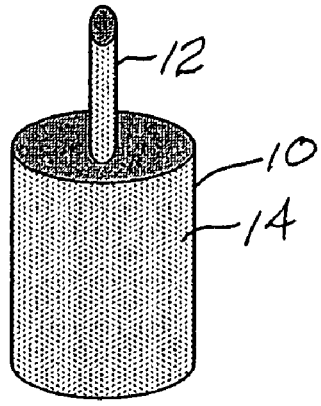
FIG. 2 PRIOR ART
FIG. 2 is a schematic perspective view of the pattern of FIG. 1 with a ceramic coating of the prior art.

Other embodiments of the invention are also possible. For example, a ceramic coating of the prior art 14 (referring back to FIG. 2) could be used with an erodable backing 34 (FIG. 8). In this instance, a solvent delivery system could decompose the erodable backing 34 while not decomposing the ceramic coating 14, which could be removed in a subsequent operation. The solvent erosion of the backing 34, however, would still lead to substantially rapid cooling of the cast metal, thereby conferring many of the above advantages on the process to create a casting with desirable properties.

Figure 11:
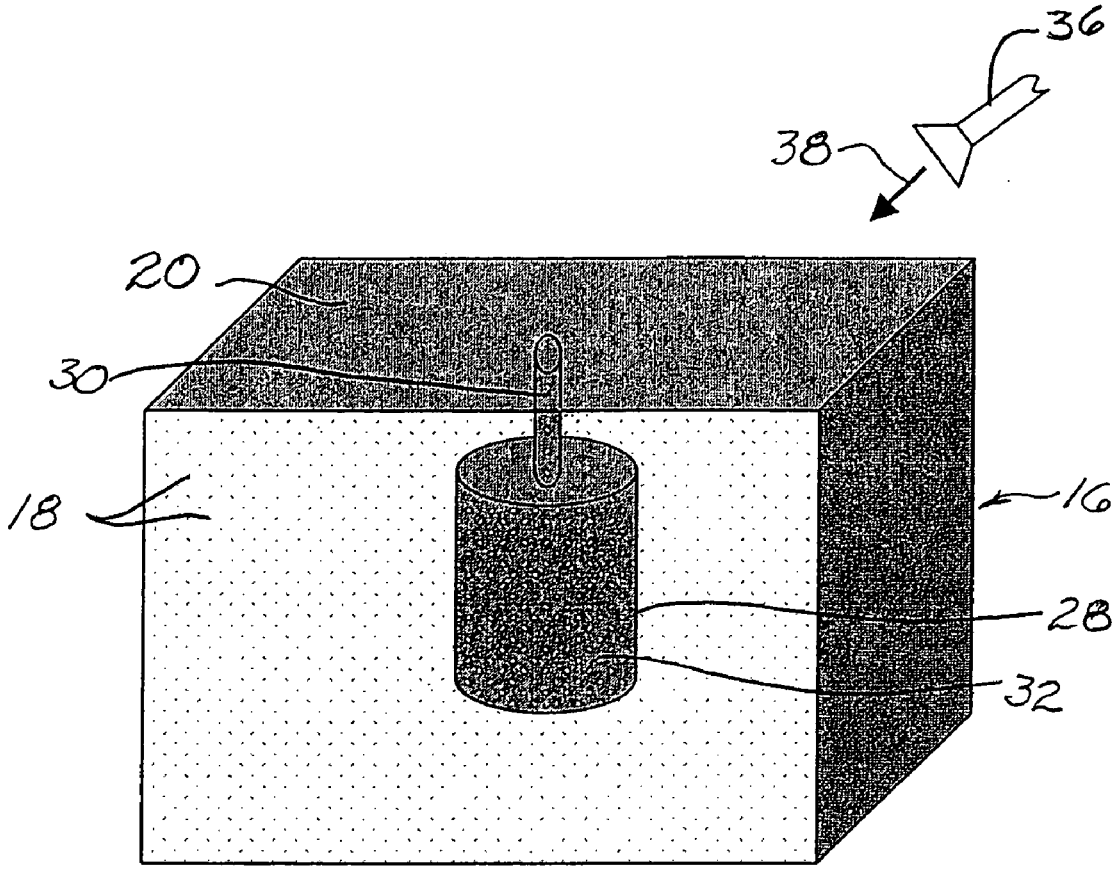
FIG. 11 is a schematic perspective view of yet another embodiment of the present invention.

Turning to FIG. 11, an erodable coating 32 may be used on a pattern 28 and supported by an unbonded particulate material backing 18 in a flask 16. The flask 16 may be designed to allow a solvent delivery system, such as a nozzle 36, to direct solvent 38 at the unbonded particulate material 18 and allow it to flow out of the flask 16, carrying the particulate material 18 with it. For example, the nozzle 36 may be so used as to expel the unbonded particulate material 18 from the top of the flask 16 downward. When at least a portion of the unbonded particulate material 18 is expelled, the solvent 38 may contact the erodable coating 32 to decompose it. As a result, the cast metal can be rapidly cooled in a manner similar to that described above, thereby imparting similar desirable characteristics upon the casting.

Figure 3:
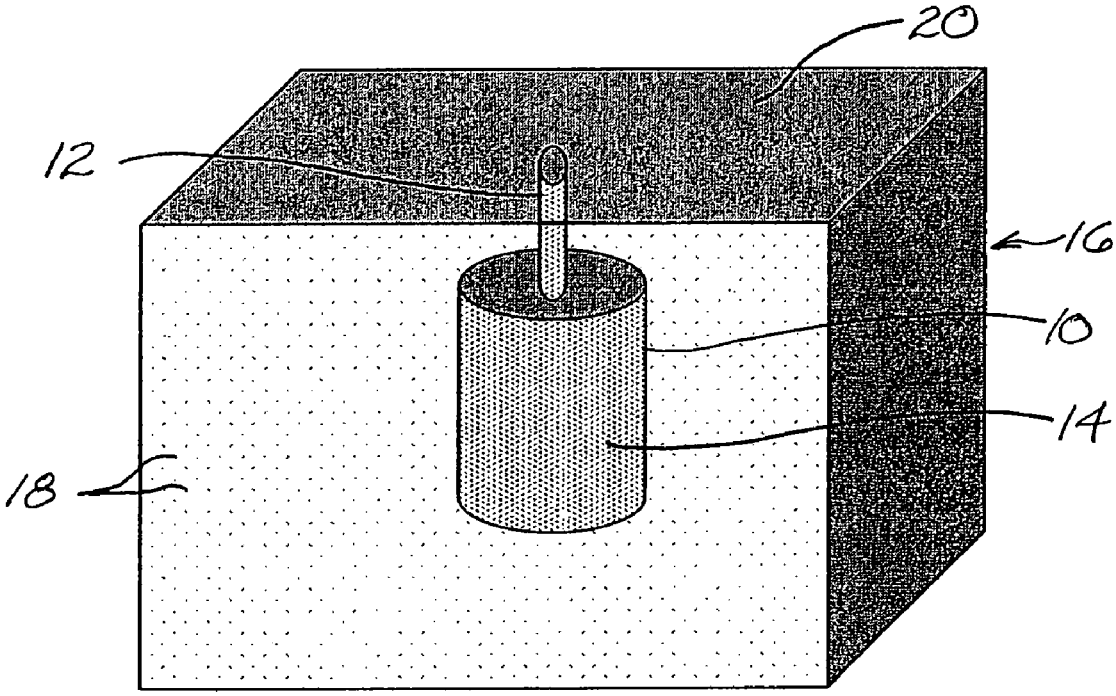
FIG. 3 PRIOR ART
FIG. 3 is a schematic perspective view of the pattern and coating of FIG. 2 in a flask of the prior art.
Figure 4:
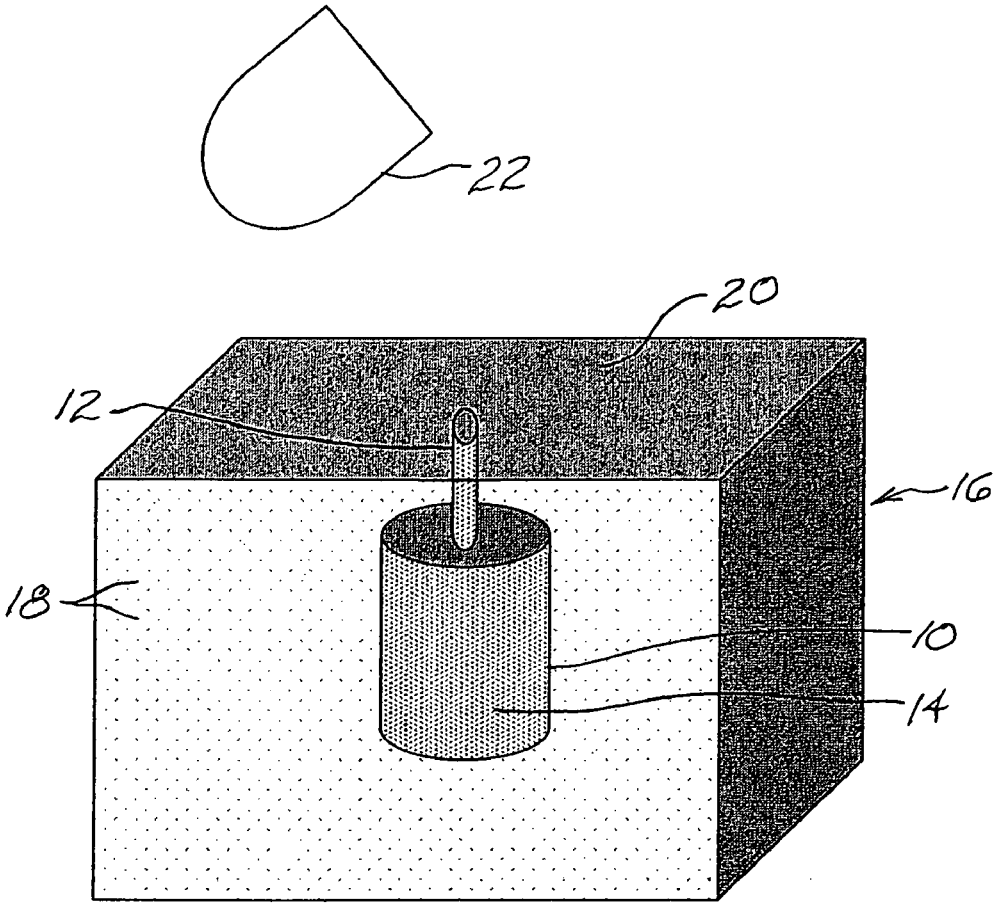
FIG. 4 PRIOR ART
FIG. 4 is a schematic perspective view of the pattern and flask of FIG. 3 with a crucible.
Figure 5:
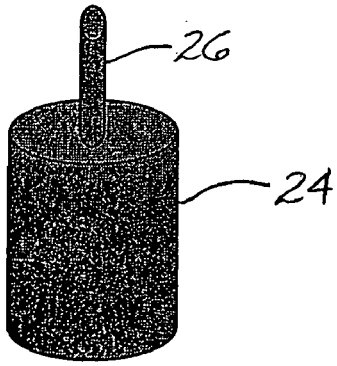
FIG. 5 PRIOR ART
FIG. 5 is a schematic perspective view of a casting of the prior art.

It is also possible to use the solvent delivery system with a ceramic coating of the prior art 14 (FIG. 2) that is supported by an unbonded backing particulate material 18 in a flask 16 (FIG. 3). The flask 16 may be designed to allow a solvent delivery system, as described herein, to direct solvent at the unbonded particulate material 18 and allow it to flow out of flask 16 with the particulate material 18, such as from the top of the flask 16 downward. The ceramic coating 14 could be removed in a subsequent operation. The rapid expulsion of the unbonded particulate material 18 by the solvent would lead to substantially rapid cooling of the cast metal, once again conferring many of the above advantages on the process to create a casting with desirable properties.

With reference again to FIG. 8, it is also possible to combine the erodable coating 32 and the erodable backing 34 so that there is one layer of an aggregate containing a particulate material and a soluble binder about the pattern 28 that acts to both contain the molten metal and provide support. In this embodiment, the erodable backing 34 may be directly placed on the pattern 28, without the need for a separate coating 14 or 32. The erodable backing 34 is of a sufficient viscosity to appropriately coat the surface of the pattern 28 and its corresponding features and to achieve the desired surface characteristics. Accordingly, the amount of binder in the erodable backing 34 may thus vary for each particular lost pattern casting application, taking into account such considerations as the geometry of the pattern 28, surface characteristics and heat transfer requirements. This need for different viscosities of a single-layer mold for different applications leads to the surrounding of the pattern 28 with the erodable backing 34 by dipping, spraying, compacting or other techniques described above or known in the art (as the viscosity of the backing 34 dictates). Once the pattern 28 is surrounded by the erodable backing 34, a solvent may then decompose the single layer as described above to provide rapid cooling of the cast metal.

As is apparent from the foregoing detailed description, a method for the lost pattern casting of metals, is also disclosed. The method comprises the production of castings in accordance with the steps that are presented in the process detailed in FIGS. 6–11 and the accompanying description above.

It is to be noted that the invention is suitable for the lost pattern, i.e., investment, casting of any metal, including non-ferrous alloys based on magnesium, aluminum and copper, as well as ferrous alloys and high temperature alloys such as nickel-based and similar alloys.

With the present invention, one can avoid the use of a coating. The necessity for a coating is removed because loose, unbonded particulate material is no longer used, it being replaced by weakly bonded aggregate. Thus, the danger of collapse of the mold during filling is thereby avoided. The coating is one of the major control problems for lost foam castings, since its viscosity and thickness of the coat has a major effect on filling, but is not easily controlled. Advantages of avoiding the coating include reduction of cost and reductions in drying time and the large inventory and floor space needed for drying patterns.

A serious defect that is hard to avoid in the prior art is the penetration of the coating into tiny crevices of unsealed glued joints, which leads to cast-in sharp cracks in the surface of the casting. In addition, any loosely compacted foam is also faithfully replicated, causing the casting to suffer cosmetic defects, or even fatigue-enhanced problems. Surrounding the foam pattern directly with an aggregate instead of a ceramic slurry allows these difficulties to be smoothed over, because the larger particle size of the particulate material of the aggregate cannot penetrate such minute surface features of the foam, and is thus a major advantage of avoiding the coating.

During casting, it is also to be expected that the liquid styrene degradation product will be able to disperse more readily directly into an aggregate without the presence of a coating. When attempting to disperse into the coating, the 'wicking' action of the coating causes the coating to take up the liquid, so that the coating becomes temporarily impermeable to the escape of gases, particularly the entrained air and other low boiling point volatiles in the foam itself. Thus, there is considerable danger of gas entrapment.

The invention has been described with reference to several preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A process for the lost pattern casting of metals, said process comprising the steps of:

forming a pattern from a material;

forming an erodable coating around at least a portion of said pattern to form a mold, said coating comprising a particulate material and a binder;

removing said pattern from said mold;

delivering molten metal into said mold;

cooling said molten metal such that it only partially solidifies into a casting; and removing at least a part of said mold with a solvent while the casting is partially solidified.

2. A process according to claim 1, wherein said material for forming said pattern comprises foam.

3. A process according to claim 1, wherein said step of delivering a molten metal into said mold and said step of removing said pattern from said mold occur approximately simultaneously.

4. A process according to claim 1, further comprising the step of forming an erodable backing around at least a portion of said erodable coating, said erodable backing comprising a particulate material and a binder.

5. A process according to claim 4, further comprising the steps of:

contacting said erodable backing with a solvent; and removing at least a part of said erodable backing.

6. A process according to claim 4, wherein a weight percent of said binder in said erodable coating is greater than a weight percent of said binder in said erodable backing.

7. A process according to claim 1, wherein said step of forming an erodable coating around at least a portion of said pattern to form a mold is performed by dipping said pattern into a slurry comprising said coating.

8. A process according to claim 1, further comprising the step of attaching a gate to said pattern.

9. A process according to claim 8, wherein the step of delivering molten metal into said mold is performed by delivering molten metal through said gate.

10. A process according to claim 1, wherein said binder is soluble in said solvent.

11. A process according to claim 1, wherein said solvent comprises water.

12. A process according to claim 1, wherein said step of contacting said mold with a solvent comprises the step of spraying the solvent.

13. A process according to claim 1, wherein said mold is permeable to said solvent.

14. A process according to claim 1, wherein said step of contacting said mold with a solvent comprises the step of delivering the solvent to said mold in an amount of from 0.5 to 50 liters per second and at a pressure from 0.03 to 70 bar.

15. A process according to claim 1, wherein said solvent contains at least one of a grit and a surfactant.

16. A process according to claim 1, wherein the steps of removing at least a portion of said mold and cooling the molten metal are performed approximately simultaneously.

17. A process according to claim 1, wherein said step of cooling comprises contacting a shell of solidifying metal around said molten metal with said solvent.

18. A process according to claim 1, wherein said step of cooling comprises the step of using an already cooled portion of the casting as a chill to remove heat from a still molten portion of the casting.

19. A process according to claim 1, wherein said steps of (i) contacting said mold with a solvent; (ii) cooling said molten metal such that it at least partially solidifies to form a casting; and (iii) removing at least a part of said mold; are performed by lowering said mold into a bath of said solvent.

20. A process for the lost pattern casting of metals, said process comprising the steps of:

forming a pattern from a material;

forming a coating around at least a portion of said pattern to form a mold;

forming a backing around at least a portion of said mold;
removing said pattern from said mold;
delivering molten metal into said mold;
cooling said molten metal such that it partially solidifies to form a partially solidified casting,
contacting said backing and said mold with a solvent to decompose at least a part of said backing and at least a part of said mold; and
contacting the casting with solvent to further solidify the casting.

21. A process according to claim 20, wherein said steps of (i) contacting said backing with a solvent to decompose at least a part of said backing; and (ii) cooling said molten metal such that it at least partially solidifies to form a partially solidified casting; are performed by lowering said mold into a bath of said solvent.

22. A process according to claim 20 wherein the molten metal comprises aluminum and the solvent comprises water.

23. A process for the lost pattern casting of metals, said process comprising the steps of:
forming a pattern from a material;
forming an erodable coating around at least a portion of said pattem to form a mold, said coating comprising a particulate material and a binder;
delivering molten metal into said mold;
directing a fluid stream at the mold when a casting in the mold is partially solidified; and,
dislodging at least a portion of the mold, including at least a portion of the particulate material, from the casting while the casting remains only partially solidified.

24. A process according to claim 23 further comprising removing said pattern from said mold and wherein said step of delivering a molten metal into said mold and said step of removing said pattern from said mold occur approximately simultaneously.

25. A process according to claim 23 further comprising the step of forming an erodable backing around at least a portion of said erodable coating, said erodable backing comprising a particulate material and a binder.

26. A process according to claim 25 further comprising the steps of contacting said erodable backing with the fluid stream and removing at least a part of said erodable backing.

27. A process according to claim 23 further comprising the step of attaching a gate to said pattern.

28. A process according to claim 27 wherein said step of delivering molten metal into said mold is performed by delivering molten metal through said gate.

29. A process according to claim 23 wherein said step of directing a fluid stream at the mold comprises the step of spraying a solvent at the mold.

30. A process according to claim 29 further comprising the step of permeating said mold with said solvent.

31. The process of claim 29 wherein said solvent is sprayed at the mold in an amount of from 0.5 to 50 liters per second and at a pressure from 0.03 to 70 bar.

32. The process of claim 23 further comprising the step of cooling said molten metal in said mold.

33. The process of claim 32 wherein said step of cooling comprises contacting a shell of solidifying metal around said molten metal with said fluid stream.

34. The process of claim 33 wherein said step of cooling comprises the step of using an already cooled portion of the casting as a chill to remove heat from a still molten portion of the casting.

35. The process of claim 23 further comprising continuing to solidify the casting.

36. A process for the lost pattern casting of metals, comprising:
forming a pattern from a material;
forming an erodable coating around at least a portion of the pattern to form a mold, the coating comprising a particulate material and a binder;
delivering molten metal into the mold;
directing a fluid stream at the mold when a casting in the mold is only partially solidified;
dislodging at least a portion of the mold, including at least a portion of the particulate material, from the casting with the fluid stream; and,
continuing to solidify the molten metal remaining in the casting.

37. The process of claim 36 further comprising removing the pattern from the mold.

38. The process of claim 36 further comprising permeating the mold with the solvent.

39. The process of claim 36 further comprising cooling the casting.

40. The process of claim 36 further comprising forming a shell of solidifying metal in the casting, the shell of solidifying metal enclosing remaining molten metal.

41. The process of claim 36 further comprising using an already cooled portion of the casting as a chill to remove heat from a still molten portion of the casting.

42. The process of claim 36 wherein the step of directing the fluid stream comprises spraying a solvent at the mold.

43. The process of claim 42 wherein the step of directing includes spraying multiple streams of solvent at the mold.

44. The process of claim 43 wherein the multiple streams of solvent are sprayed from multiple directions.

45. The process of claim 36 further comprising moving the mold in relation to the fluid stream during the step of directing a fluid stream at the mold.

46. The process of claim 36 wherein the fluid stream includes a solvent and the step of dislodging at least a portion of the mold comprises dissolving the mold with the solvent.

47. The process of claim 46 wherein the solvent comprises water.

* * * * *